US006826796B1

(12) United States Patent
Mossbeck

(10) Patent No.: US 6,826,796 B1
(45) Date of Patent: Dec. 7, 2004

(54) POCKETED BEDDING OR SEATING PRODUCT HAVING STRINGS OF SPRINGS WITH VERTICALLY OFFSET POCKETS

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/635,251

(22) Filed: Aug. 6, 2003

(51) Int. Cl.[7] ..... A47C 23/04

(52) U.S. Cl. ..... 5/720; 5/655.8; 5/716; 5/727

(58) Field of Search ..... 5/655.8, 716, 720, 5/727

(56) References Cited

U.S. PATENT DOCUMENTS

| | | | |
|---|---|---|---|
| 1,852,943 | A | 4/1932 | Swanson |
| 2,236,007 | A | 3/1941 | Oldham |
| 2,568,055 | A | 9/1951 | Clark |
| 4,439,977 | A | 4/1984 | Stumpf |
| 4,679,266 | A | 7/1987 | Kraft |
| 6,101,697 | A | 8/2000 | Stumpf et al. |
| 6,122,787 | A | 9/2000 | Kao |
| 6,143,122 | A | 11/2000 | Mossbeck et al. |
| 6,170,807 | B1 | 1/2001 | Eto |
| 6,173,464 | B1 | 1/2001 | McCune et al. |
| 6,353,952 | B1 | 3/2002 | Wells |
| 6,397,418 | B1 | 6/2002 | Stjerna |
| 6,398,199 | B1 | 6/2002 | Barber |
| 6,540,214 | B2 | 4/2003 | Barber |
| 6,758,464 | B2 | 7/2004 | Grothaus |

FOREIGN PATENT DOCUMENTS

| | | |
|---|---|---|
| DE | 93 16 223.5 | 10/1993 |
| DE | 297 22 598 | 2/1998 |
| WO | WO 94/18116 | 8/1994 |
| WO | WO 2004/039215 | 5/2004 |

OTHER PUBLICATIONS

U.S. patent application Publication No. US 2003/0218285, *Innerspring Assembly and Method of Making an Inner Spring Assembly,* Grothaus.

Barber, James R., U.S. Patent Publication No. US 2004/0128773 A1, "Coil Innerspring Assembly Having Varying Degrees of Firmness", Published Jul. 8, 2004.

*Primary Examiner*—Teri Pham Luu
(74) *Attorney, Agent, or Firm*—Wood, Herron & Evans, LLP

(57) ABSTRACT

A bedding or seating product is provided comprising a pocketed spring assembly made up of a plurality of parallel strings of springs joined to each other. Each string of springs comprises a row of interconnected pocketed springs. The pockets of fabric are vertically shortened with seams to create pockets of the same height, each containing a spring. The springs are vertically offset from one another due to the location of the seams. Upon an initial load, only some of the pocketed springs are compressed.

29 Claims, 5 Drawing Sheets

POCKETED BEDDING OR SEATING PRODUCT HAVING STRINGS OF SPRINGS WITH VERTICALLY OFFSET POCKETS

FIELD OF THE INVENTION

This invention relates generally to spring assemblies for mattress, cushions and other bedding or seating products and, more particularly, to a pocketed coil spring assembly and associated method of manufacturing such an assembly.

BACKGROUND ON THE INVENTION

A well known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string of pocketed springs. A bedding or seating product can be fabricated from such strings of pocketed springs by binding or adhering the individual rows or strings of pocketed springs together to form a spring assembly which may be padded and encased in an upholstered covering. U.S. Pat. No. 6,143,122, which is fully incorporated herein, discloses one such method of adhesively bonding strings of pocketed springs together to form a pocketed spring assembly.

This type of spring assembly is commonly referred to as a pocketed spring assembly due to the fact that each spring is contained within an individual pocket of fabric material. The construction of strings of pocketed coil springs in each pocket is well known in the art and, for example, is disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO 94/18116 and U.S. Pat. No. 6,101,697, each of which are expressly incorporated herein by reference.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

One particular aspect of pocketed spring assemblies and the associated mattresses or the like is that the resulting product may have a "hard" feel due to the fact that all of the coil springs are identical and compressed to the same degree in individual pockets. Usually, the firmness of such a product is uniform across the width and along the length of the product.

Additionally, while pocketed spring assemblies are desirably provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

One known method of posturizing a pocketed spring unit has been to incorporate springs made of different gauge wire into the strings of springs. For example, the springs incorporated into the strings of springs within certain sections or zones of the spring assembly are made of a heavier gauge wire than the springs incorporated into the strings of springs of the other sections or zones of the spring assembly. Pat. No. 6,173,464 discloses this concept, albeit with continuous bands of springs as opposed to individual springs.

Therefore, there is a need for a pocketed spring assembly which has an initial soft feel but the firmness necessary to support heavy loads.

There is further a need for a posturized pocketed spring assembly and associated method of manufacture which offers the advantages of posturization of the pocketed spring assembly without the higher manufacturing costs, production difficulties and inefficiencies associated with known posturized pocketed spring assemblies.

SUMMARY OF THE INVENTION

The invention of this application comprises a pocketed bedding or seating product and associated method of manufacture. The bedding or seating product comprises a pocketed spring assembly, one or more pads and an upholstered covering surrounding the pocketed spring assembly and pads. The product is preferably two sided and may be used on either side.

The pocketed spring assembly comprises a plurality of parallel strings of springs joined together. Each of the strings of springs comprises a row of interconnected pocketed springs. Each of the pocketed springs comprises a spring surrounded with a pocket of fabric, as is conventional. Although coil springs are preferably used, other types of springs may be used in accordance with the present invention. Each of the coil springs has an upper end turn, a lower end turn and a plurality of central convolutions between the end turns.

Preferably, each string of springs is made of one piece of fabric folded to create two opposed plies which are joined together in select locations to form a plurality of pockets, each of the pockets containing a spring. The opposed plies of fabric of the string of springs may be joined together by sewing, gluing, sonic welding, as known in the art or any other means. Adjacent pockets within a string of springs are separated by generally vertically oriented lines of attachment or seams of the opposed plies to each other. The height of the pocket is determined either by: 1) the distance between the bottom surface of the string of springs and one longitudinal segment of attachment or seam of the opposed plies to each other or 2) the distance between top and bottom seams of the pocket.

In several preferred embodiments of the present invention, each string of springs, or at least long sections of each string of springs, has pockets of the same height along its length. However, the pockets are vertically offset from one another, i.e. located at different heights, due to the location of the seams. In one preferred embodiment, every other pocket of fabric is located slightly above the adjacent pockets of fabric, so that every other pocketed spring is higher than the adjacent pocketed springs in at least some strings of springs. For purposes of this document, the higher pocketed springs will be called "high" pocketed springs and the lower pocketed springs will be called "low" pocketed springs. Similarly, the higher pockets will be called "high" pockets and the lower pockets will be called "low" pockets.

When a load is initially placed on the product from above, the "high" pocketed springs are the only pocketed springs initially compressed. These "high" pocketed springs are initially compressed downwardly until their upper end turns are generally coplanar with the upper end turns of the "low" pocketed springs. If the load is sufficient, the "low" pocketed springs will be compressed as well as the "high" pocketed springs.

Preferably, the springs are identical in a string of springs, i.e. have the same height, diameter, pitch, etc. However, the springs may be different in a string of springs, i.e. have different physical characteristics. Again, although coil springs are preferred, any type of spring may be used in accordance with the present invention.

The concept of the present invention may also be used to posturize a bedding or seating product, i.e., make certain regions or portions firmer than other areas or portions of the bedding or seating product. This is accomplished by grouping together multiple strings of springs of the same configuration. For example, each string of springs in a pocketed spring assembly used in a posturized product may have several "high" pocketed coil springs next to each other in a group and a plurality of "low" pocketed coil springs in another group. The strings of springs may have any number of such groups of pocketed springs. Each group of pocketed springs is located at the same height, thereby defining one region of a bedding or seating product. The strings of springs of the other regions of the product have pocketed coil springs at different heights so as to impart different firmnesses to the different regions.

In another preferred embodiment of the present invention, the perimeter of the product has pocketed springs which are larger than the springs in an internal portion of the product. The perimeter pocketed springs provide edge support to the product. In one such preferred embodiment having longitudinally extending strings of springs, the outermost strings of springs along the sides of the product have higher pockets containing larger springs along the entire length of the string of springs. The internal strings of springs therebetween have at least one larger pocketed spring at each end of the string of springs, between which may be alternating "high" and "low" pocketed springs or at least some "low" pocketed springs of a lesser height than the perimeter pocketed springs. The "high" and "low" pocketed springs of a portion of the internal strings of springs are the same height, but vertically offset from one another due to the location of the seams of the pockets. The springs are preferably identical coil springs, although they may be different from one another in some regard.

The bedding or seating product typically has a longitudinal dimension and a transverse dimension, the longitudinal dimension being greater than the transverse dimension. However, the longitudinal dimension and transverse dimension may be identical in a square bedding or seating product. In the invention of the present application, the strings of springs may extend longitudinally or transversely, depending upon the desired effect.

Adjacent strings of springs of the bedding or seating product are preferably glued together but may be otherwise secured to each other. At least one border wire may extend around the perimeter of the pocketed spring assembly of the bedding or seating product and be secured to select outermost pocketed coil springs. A first or lower border may be secured to the lower end turns of the coil springs of the outermost strings. A second or upper border wire may be secured to the upper end turns of the coil springs of the outermost strings or, alternatively, either border wire may be secured to intermediate convolutions of the coil springs of the outermost strings of springs.

Due to select coil springs being pocketed at a higher location than other pocketed coil springs in at least one section or region of the pocketed spring assembly, at least one section of the pocketed spring assembly has a "soft" feel when a load is placed thereon. Once such "high" pocketed coil springs are compressed to the level of the "low" pocketed coil springs, all the pocketed coil springs of the region of the pocketed spring assembly may be compressed, if necessary to support the load.

One method of manufacturing the pocketed spring assembly of the present invention comprises inserting at least one spring between opposed plies of fabric of a string of springs. The opposed plies of the string of springs are then joined in select locations with seams to create a pocket. A plurality of pocketed springs are created in this manner within each string of springs. Each pocket is the same height and contains at least one spring. In one preferred embodiment, every other pocket within the string of springs is vertically offset from adjacent pockets such that every other pocketed coil spring is located slightly above adjacent pocketed coil springs. In such an embodiment, every other spring is located at a height less or greater than the adjacent pocketed springs in the string of springs. The strings of springs are then joined together to form the pocketed spring assembly and the pocketed spring assembly encased in an upholstered covering to create the product.

The method of manufacturing the posturized spring assembly of the present invention varies depending upon the desired posturization. However, in each of the applications of the present invention whenever pocketed springs are vertically spaced above other pocketed springs and incorporated into a portion of a string of springs, that region or section of the pocketed spring assembly has an initial "soft" feel when a load is placed thereon. This initial "soft" feel is desirable to many customers or users of the product.

In each of the embodiments of the present invention, incorporating pockets of the same height but vertically offset from one another into at least several strings of springs results in a pocketed spring assembly having an initial "soft" feel in a portion thereof. Such a product may be made in accordance with a customer's needs and desires quickly and easily.

These and other objects and advantages of the present invention will be more readily apparent from the following drawings.

DETAILED DESCRIPTION OF THE DRAWINGS

Figure 1:
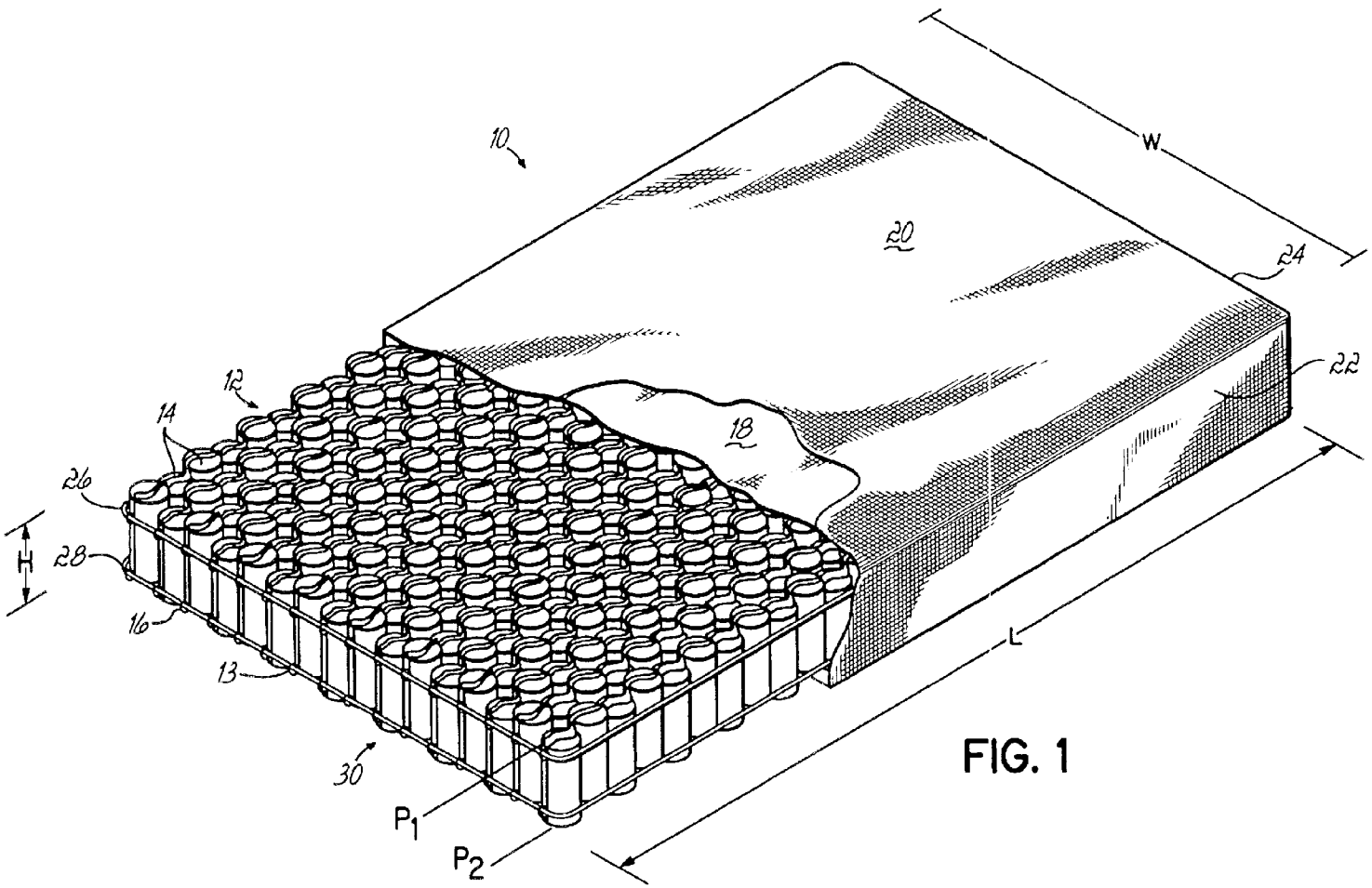
FIG. 1 is a perspective view of a bedding product made in accordance with the present invention comprising a pocketed spring assembly having a plurality of longitudinally extending strings of springs surrounded by generally rectangular border wires.

Referring to the drawings, and particularly to FIG. 1, there is illustrated a bedding or seating product in the form of a mattress 10. Although a mattress 10 is illustrated, the present invention may be used to construct any bedding or seating product. The mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces 14, 16 of the pocketed spring assembly 12. An upholstered covering 20 encases the pocketed spring assembly 12 and the covering pads 18.

The mattress 10 has a height H defined as the distance between the top and bottom surfaces 14, 16 of the spring assembly 12. Similarly, the mattress 10 has a transverse dimension or width W defined between opposed side surfaces 22 and a longitudinal dimension or length L defined as the distance between the opposed end surfaces 24 of the mattress 10. The longitudinal dimension is illustrated as being larger than the transverse dimension of the mattress 10, although it is within the contemplation of the present invention that the longitudinal and transverse dimensions be identical, such as in a square product.

Figure 1A:
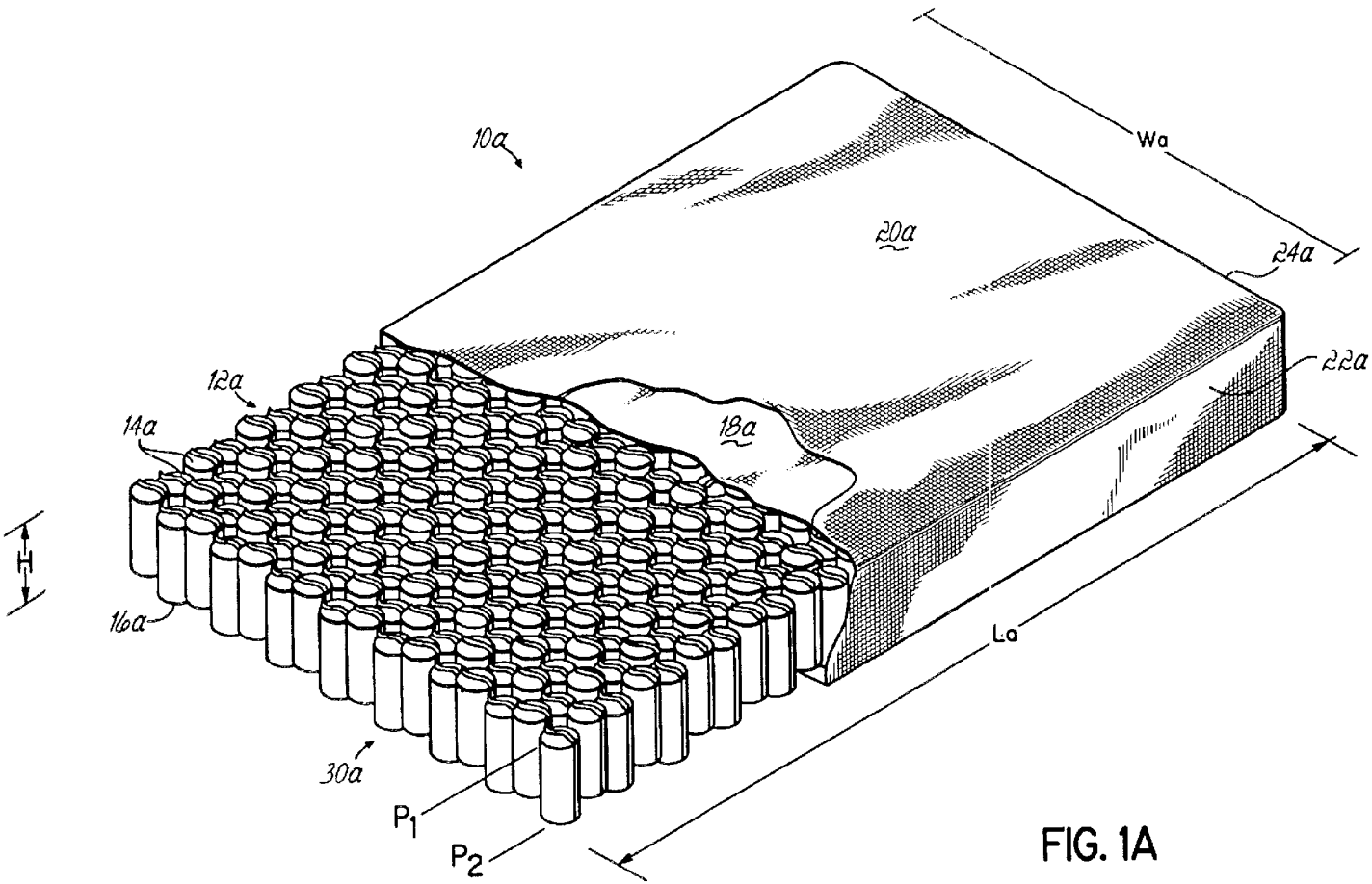
FIG. 1A is a perspective view of a bedding product made in accordance with the present invention, the strings of springs of the pocketed spring assembly extending transversely.

If desired, at least one border wire may be secured to the pocketed spring assembly 12 with hog rings or any other conventional fastener 13. FIG. 1 illustrates an upper border wire 26 and a lower border wire 28, both of which are generally rectangular, secured to the pocketed spring assembly 12. However, only one border wire may be used, if desired or none at all, as shown in FIG. 1A.

The pocketed spring assembly 12 comprises a plurality of longitudinally extending strings of springs 30 joined to each other. Adjacent strings of springs are preferably glued together as shown and described in U.S. Pat. No. 6,143,122, but may be joined to each other using any known technology.

Figure 2:
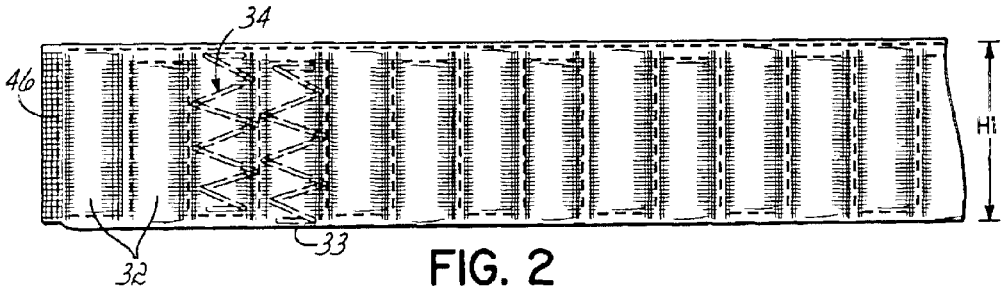
FIG. 2 is a side elevational view, partially broken away, of a string of springs made in accordance with the present invention.
Figure 3:
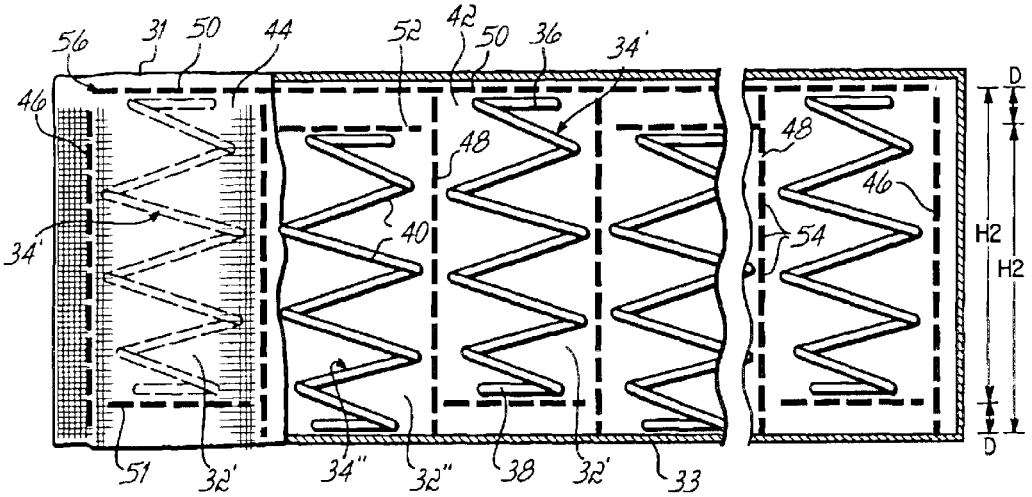
FIG. 3 is a side elevational view, partially cut away, of a portion of the string of springs of FIG. 2.

Referring to FIGS. 2 and 3, each string of springs 30 has a top or upper surface 31 and a bottom or lower surface 33, the distance between which defines the height H1 of the string of springs 30. Each string of springs 30 comprises a row of interconnected fabric pockets 32, each fabric pocket 32 containing a coil spring 34. As best illustrated in FIG. 3, each coil spring 34 has an upper end turn 36, a lower end turn 38 and a plurality of central convolutions 40 between the end turns 36, 38.

Preferably, only one piece of fabric is used to form a string of springs 30, the piece of fabric being folded over onto itself around the coil springs 34 to create a first ply 42 and a second ply 44. As illustrated in FIG. 3, the first ply 42 is behind the second ply 44. As is known in the art, opposite sides or plies of the fabric are sewn, welded or otherwise secured together in order to create a pair of outermost seams 46, a plurality of internal seams 48 and a plurality of longitudinal seams 50, 51 and 52. Longitudinal seam 50 extends from one outermost seam 46 to the opposite outermost seam 46, approximately the entire length of the string of springs 30. Longitudinal seams 51, 52 are much shorter than longitudinal seam 50 and extend approximately the length of one pocket 32. Longitudinal seams 51 are located below the pockets 32 while longitudinal seams 52 are located above the pockets 32. The internal seams 48 separate adjacent pockets 32 and therefore adjacent coil springs 34. Although the seams 46, 48, 50, 51 and 52 are illustrated as being a plurality of spaced, linear segments 54, they may comprise continuous lines or a series of dots or other arrangement without departing from the spirit of this application.

FIGS. 2 and 3 illustrate one preferred embodiment of the present invention. In this embodiment, each string of springs 30 has pockets of the same height H2. However, due to the location of seams 50, 51 and 52 every other pocket 32 is located either above or below adjacent pockets 32. Referring to FIGS. 2 and 3, the outermost pocket and every other pocket is a "high" pocket 32' whose height is defined by the distance between longitudinal seams or segments 50 and 51. The outermost pocket 32' is defined by the longitudinal seams 50, 51 along with outermost seam 46 and an internal seam 48. As best illustrated in FIG. 3, the seam 51 is spaced a distance D from the bottom surface 33 of the string of springs 30. Coil spring 34' is located inside the "high" pocket 32' and once the pocket 32' is closed is considered a "high" pocketed coil spring 34'.

Immediately adjacent each "high" pocketed coil spring 34' is at least one "low" pocketed coil spring 34" secured inside a "low" pocket 32". Each low"pocket 32" is the same height H2 as the "high" pocket 32' but is vertically offset therefrom a distance D. See FIG. 3. Each "low" pocket 34" is defined by two internal seams 48, the lower surface 33 of the string of springs 30 and a longitudinal seam 52 spaced below the longitudinal seam 50 a distance D.

Immediately adjacent to "low" pocketed coil spring 34' is at least one "high" pocketed coil spring 34' secured inside a "high" pocket 32'. Thus, every other "high" pocketed coil spring 34' is held in a "high" pocket 32'. Similarly, every other "low" pocketed coil spring 34" is held in a "low" pocket 32". The height of each of the "high" pockets 32' is preferably substantially identical and defined by the distance between the longitudinal seams 50, 51, each seam 51 being inwardly spaced from the bottom surface 33 of the string of springs 30. The height of each of the "low" pockets 32" is preferably substantially identical and defined by the distance between the bottom surface 33 of the string of springs 30 and one of the longitudinal seams 52.

Preferably, all of the coil springs 34 within a string of springs 30 are all the same height before being compressed and inserted into the pockets 32 of the strings of springs 30. Due to the identical heights of the "high" and "low" pockets, 32', 32", the coil springs 34" located in the "low" pockets 32" are compressed or loaded the same degree as the coil springs 34" located in the tall pockets 32'. In one preferred embodiment of the present invention, the coil springs 34 in the pockets 32 are not compressed at all, but rather in a relaxed condition.

The practical result of each of the strings of springs 30 being made of alternating "high" and "low" pockets of the same height, each pocket containing a coil spring, is that the pocketed spring assembly 12 has a checkerboard pattern. Consequently, the mattress 10 has an initial"soft" feel when a load is placed thereon due to the coil springs 34' in the "high" pockets 32' initially compressing before the coil springs 34" in the "low" pockets 32" are affected. This is true when the mattress or bedding or seating product is used on either side. For example, when a person initially lays on the mattress 10, the coil springs 34' in the "high" pockets 32' compress a first distance D to the upper end turns of the coil springs 34" in the "low" pockets 32". Then, all of the coil springs which are placed under a load regardless of whether they are in a "high" or "low" pocket.

FIG. 1A illustrates an alternative embodiment of the present invention comprising a mattress 10*a*. The mattress 10*a* comprises a pocketed spring assembly 12*a* having a generally planar top surface 14*a* in a top plane P1 and a parallel generally planar bottom surface 16*a* in a bottom plane P2. Covering pads 18*a* (only one being shown) may be located on the top and bottom surfaces 14*a*, 16*a* of the pocketed spring assembly 12*a*. An upholstered covering 20*a* encases the pocketed spring assembly 12*a* and the covering pads 18*a*.

The pocketed spring assembly 12*a* comprises a plurality of transversely extending strings of springs 30*a* joined to each other. Adjacent strings of springs 30*a* are preferably glued together but may be joined to each other using any known technology. The strings of springs 30*a* are similar to those described above with regard to the embodiment shown in FIG. 1 and made in same manner. Like the embodiment of FIG. 1, this embodiment has a uniform composition or construction along its length and width.

The mattress 10*a* has a transverse dimension or width Wa defined between opposed side surfaces 22*a* and a longitudinal dimension or length La defined as the distance between the opposed end surfaces 24*a* of the mattress 10*a*. The longitudinal dimension is illustrated as being larger than the transverse dimension of the mattress 10*a*, although it is within the contemplation of the present invention that the longitudinal and transverse dimensions be identical, such as in a square product.

Figure 4:
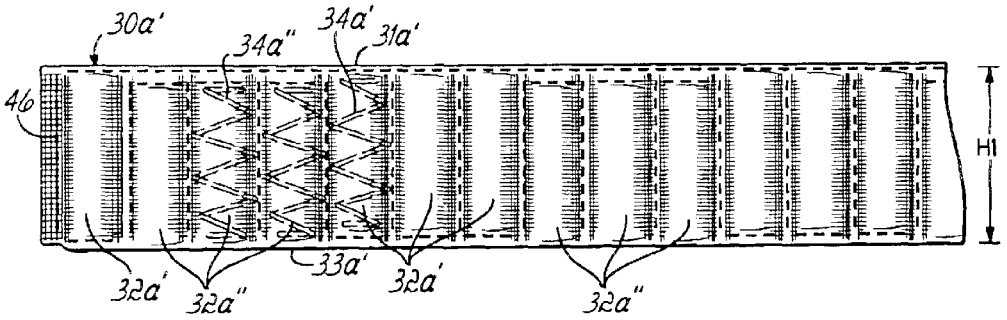
FIG. 4 is a side elevational view, partially broken away, of a string of springs made in accordance with the present invention.

FIG. 4 illustrates an alternative embodiment of the present invention in which several identical strings of springs are grouped together in a posturized bedding or seating product having regions of differing firmness. FIG. 4 illustrates one such string of springs 30*a'* having an upper or top surface 31*a* and a lower or bottom surface 33*a*. In this preferred embodiment, each string of springs 30*a'* has extending from left to right in FIG. 4, an outermost "high" pocket 32*a'*, three "short" pockets 32*a"*, two "high" pockets 32*a'*, three "low" pockets 32*a"*, etc. Each "high" pocket 32*a'* has a coil spring 34*a'* therein and each "low" pocket 32*a"* has a coil spring 34*a"* therein. The regions of the string of springs 30*a'* having "high" pocketed coil springs 34*a'* provide an initial "soft" feeling when a load is placed thereon. Although one particular pattern of string of springs 30*a'* is illustrated and described, any other configurations of strings of springs may be used to create a posturized bedding or seating product in accordance with the present invention.

Figure 5:
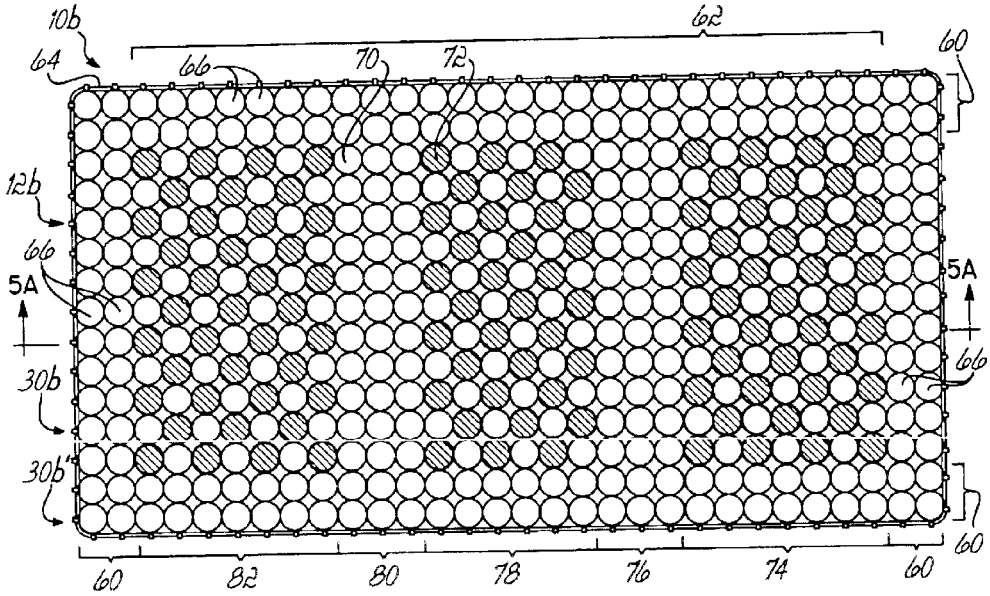
FIG. 5 is a top plan view of an alternative embodiment of pocketed spring assembly made in accordance with the present invention.
Figure 5A:
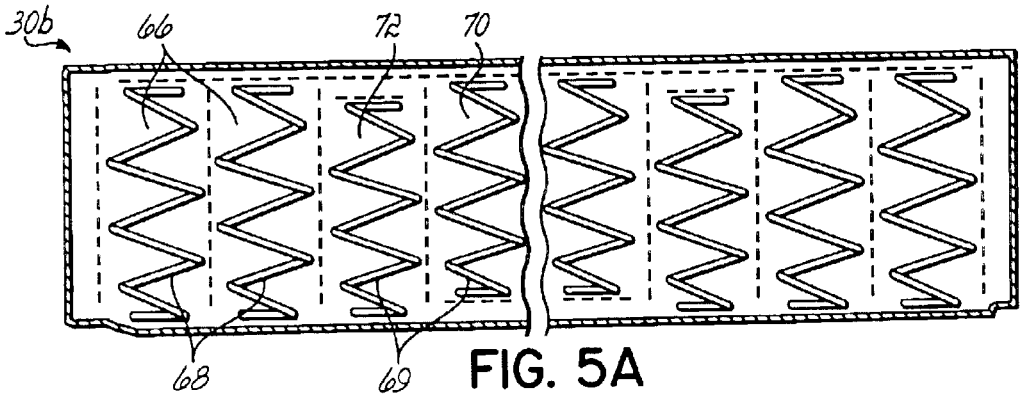
FIG. 5A is a cross-sectional view taken along the line 5A-5A of FIG. 5.

FIGS. 5 and 5A illustrate an alternative embodiment of the present invention in which the mattress 10*b* is posturized, the mattress 10*b* having multiple regions of differing firmness. In this embodiment, the mattress 10*b* has a pocketed spring assembly 12*b* which is divided into multiple regions or sections as one moves longitudinally down the side of the mattress. At least one border wire 64 is secured to the pocketed spring assembly 12*b*. However, if desired the border wire may be omitted. Around the perimeter of the mattress 10*b* is an edge portion 60 surrounding an internal portion 62. The edge portion 60 comprises two longitudinally extending strings of springs 30*b'* on each side of the mattress 10*c*. Each of these strings of springs 30*b'* has a uniform composition along its length. Each of the pockets 66 in each string of springs 30*b'* is the same height, higher than the "high" and "low" pockets 70, 72, respectively, of the internal portion 62 of the product 10*b*. Each of the larger pockets 66 contains a larger or taller coil spring 68 than the coil springs 69 contained in the "high" and "low" pockets 70, 72, respectively, of the internal portion 62 of the product 10*b*. See FIG. 5A. The coil springs 69 contained in the "high" and "low" pockets 70, 72, respectively, of the internal portion 62 of the product 10*b* are preferably the same height.

In this preferred embodiment shown in FIGS. 5 and 5A, the internal portion 62 of the pocketed spring assembly 12*b* comprises a plurality of longitudinally extending strings of springs 30*b* located between longitudinally extending strings of springs 30*b'*. One such longitudinally extending string of springs 30*b* is shown in detail in FIG. 5A. Longitudinally extending strings of springs 30*b* are secured to each other in a known manner, such as by glueing for example. The two pocketed coil springs 68 at each end of each string of springs 30*b* are larger pocketed coil springs than the coil springs 69 contained in the "high" and "low" pockets 70, 72 therebetween. These pocketed coil springs 68 at each end of each string of springs 30*b* make up part of the edge portion 60 of the pocketed spring assembly 12*b*. The remaining pockets of each string of springs 30*b* between the outermost larger pockets 66 contain both "high" and "low" pockets 70, 72, respectively, containing coil springs 69 in a manner as described above.

The internal portion 62 of the pocketed spring assembly 12*b* has a head section 74, immediately adjacent head section 74 is an upper lumbar section 76, immediately adjacent upper lumbar section 76 is center section 78, immediately adjacent center section 78 is a lower lumbar section 80 and at the other end of the internal portion 62 of the pocketed spring assembly 12*b* is a foot section 82.

The practical result of this configuration of pocketed spring assembly 12*b* is that the head section 74, center section 78 and foot section 82 have a checkerboard pattern which results in an initial "soft" feel when a load is placed thereon; however these sections have additional support provided by the springs 69 in "low" pockets 72. The portions of each string of springs 30*b* in the head section 74, center section 78 and foot section 82 have alternating "high" and "low" pockets 70, 72, each containing a spring 69.

On the other hand, the portions of each string of springs 30*b* in the upper and lower lumbar sections 76, 80 contain only "high" pockets 70 containing springs 69. Therefore, the upper and lower lumbar sections 76, 80 have a "softer" firmness when compared to the head section 74, center section 78 and foot section 82.

Although the strings of springs 30*b* and 30*b'* are illustrated as being longitudinally extending, this embodiment of the present invention may also be accomplished with transversely extending strings of springs. If the strings of springs were transversely extending, each string of springs in the upper and lower lumbar sections 58, 62 would have only "high" pocketed springs and each string of springs in the head, center and foot sections 74, 78 and 82 would have alternating "low" and "high" pocketed springs, except the outermost pockets which form part of the edge portion.

Although the edge portion 60 of this preferred embodiment is illustrated and described as having larger pocketed springs 66 than the pocketed springs 69 of the internal portion 62; the edge portion 60 may be made of "high" or "low" pocketed springs 69.

Figure 6:
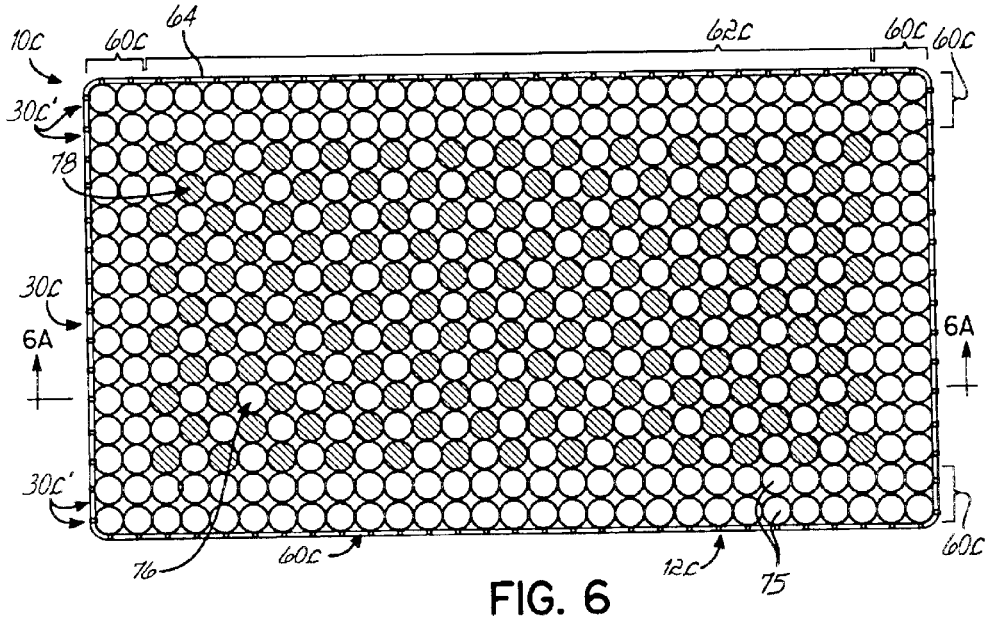
FIG. 6 is a top plan view of another alternative embodiment of pocketed spring assembly made in accordance with the present invention.
Figure 6A:
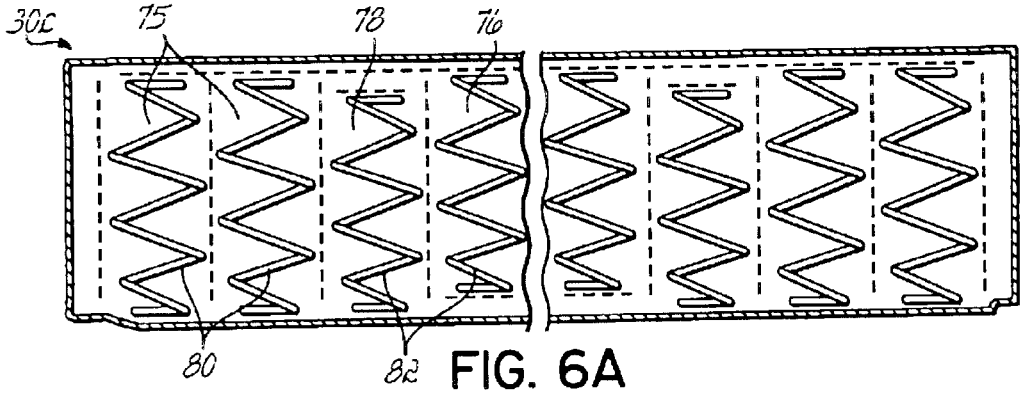
FIG. 6A is a cross-sectional view taken along the line 6A-6A of FIG. 6.

FIGS. 6 and 6A illustrate an alternative preferred embodiment of the present invention. In this embodiment, mattress 10*c* has a pocketed spring assembly 12*c* comprising longitudinally extending strings of springs 30*c*, 30*c*' joined to each other in a conventional manner. The pocketed spring assembly 12*c* has an edge portion 60*c* around the perimeter of an internal portion 62*c*. The edge portion 60*c* comprises two longitudinally extending strings of springs 30*c*' on each side of the mattress 10*c*. Each of these strings of springs 30*c*' has a uniform composition along its length. Each of the pockets 75 in each string of springs 30*c*' is the same height, higher than the "high" and "low" pockets 76, 78, respectively, of the internal portion 62*c* of the product 10*c*. Each of the larger pockets 75 contains a larger or taller coil spring 80 than the coil springs 82 contained in the "high" and "low" pockets 76, 78 of the internal portion 62*c* of the product 10*c*. See FIG. 6A. The coil springs 82 contained in the "high" and "low" pockets 76, 78 of the internal portion 62*c* of the product 10*c* are preferably the same height.

In this preferred embodiment shown in FIGS. 6 and 6A, the internal portion 62*c* of the pocketed spring assembly 12*c* comprises a plurality of longitudinally extending strings of springs 30*c* located between longitudinally extending strings of springs 30*c*'. One such longitudinally extending string of springs 30*c* is shown in detail in FIG. 6A. Longitudinally extending strings of springs 30*c* are secured to each other in a known manner, such as by glueing for example. The two pocketed coil springs 80 at each end of each string of springs 30*c* are larger pocketed coil springs than the coil springs 82 contained in the "high" and "low" pockets 76, 78 therebetween. These pocketed coil springs 80 at each end of each string of springs 30*c* make up part of the edge portion 60*c* of the pocketed spring assembly 12*c*. The remaining pockets of each string of springs 30*c* between the outermost larger pockets 75 contain both "high" and "low" pockets 76, 78, respectively, containing coil springs 82 in a manner as described above.

Although the strings of springs 30*c*, 30*c*' are longitudinally extending, this embodiment of the present invention may also be manufactured with transversely extending strings of springs.

Although the edge portion 60*c* of this preferred embodiment is illustrated and described as having larger pocketed springs 80 than the pocketed springs 82 of the internal portion 62*c*; the edge portion 60*c* may be made of "high" or "low" pocketed springs 82.

Although I have described several preferred embodiments of our invention, I do not intend to be limited except by the scope of the following claims.

I claim:

1. A bedding or seating product comprising:

a pocketed spring assembly comprising a plurality of parallel strings of springs, each of said strings of springs comprising a row of interconnected pocketed springs, each of said pocketed springs comprising a spring surrounded by a pocket of fabric, wherein within some of said strings of springs some of said pockets of fabric are of an identical vertical height and vertically offset relative to one another; and an upholstered covering surrounding said pocketed spring assembly.

2. A bedding or seating product comprising:

a pocketed spring assembly comprising a plurality of parallel strings of springs, each of said strings of springs comprising a row of interconnected pocketed springs, each of said pocketed springs comprising a spring surrounded by a pocket of fabric, wherein within some of said strings of springs some of said pockets of fabric are of an identical vertical height and vertically offset relative to one another.

3. The product of claim 2 wherein within some of said strings of springs every other one of said pockets is above adjacent pockets.

4. The product of claim 2 wherein all of said springs are the same vertical height.

5. The product of claim 2 wherein said product has a longitudinal dimension and a transverse dimension, said longitudinal dimension being greater than said transverse dimension, said strings of springs extending longitudinally.

6. The product of claim 2 wherein said product has a longitudinal dimension and a transverse dimension, said longitudinal dimension being greater than said transverse dimension, said strings of springs extending transversely.

7. The product of claim 2 wherein at least one border wire is secured to said pockets spring assembly.

8. The product of claim 2 wherein adjacent strings of springs are glued together.

9. The product of claim 2 wherein said springs are coil springs.

10. A bedding or seating product comprising:

a pocketed spring assembly comprising a plurality of parallel strings of springs joined to each other, each of said strings of springs comprising a row of interconnected pocketed springs, each of said pocketed springs comprising a spring surrounded by a pocket of fabric, wherein said pocketed spring assembly has multiple regions of differing firmness, at least one of said regions having pockets of an identical height vertically offset from one another.

11. The product of claim 10 wherein springs are identical.

12. The product of claim 10 wherein said strings of springs extend longitudinally.

13. The product of claim 10 wherein said strings of springs extend transversely.

14. The product of claim 10 further comprising at least one border wire surrounding said pocketed spring assembly.

15. A bedding or seating product comprising:

a pocketed spring assembly comprising a plurality of parallel strings of springs, each of said strings of springs comprising a piece of fabric wrapped around a row of aligned springs and secured along a longitudinal line of attachment, opposed plies of said piece of fabric being on opposite sides of the springs, said opposed plies of fabric being joined together between springs to create a plurality of pocketed springs of the same height, wherein said opposed plies of fabric are joined together in select locations to vertically offset some of the pocketed springs from other pocketed springs.

16. The product of claim 15 wherein said strings of springs extend longitudinally.

17. The product of claim 15 wherein said strings of springs extend transversely.

18. The product of claim 15 wherein each of said springs is identical.

19. A string of springs for inclusion in a bedding or seating product, said string of springs comprising a tow of interconnected pocketed springs, each of said pocketed springs comprising a spring surrounded with a pocket of fabric, adjacent pocketed springs being the same height and vertically offset from one another in a portion of said string of springs.

20. The string of springs of claim 19 wherein each of said springs is identical.

21. The string of springs of claim 19 wherein said string of springs is joined to other similar strings of springs by gluing strings of springs together to create a pocketed spring assembly.

22. A string of springs for inclusion in a bedding or seating product, said string of springs comprising a piece of fabric wrapped around a row of aligned springs and secured along a seam, opposed plies of said piece of fabric being on opposite sides of the springs, said opposed plies of fabric being joined together between springs to create a plurality of pocketed springs of the same height and vertically offset relative to one another, wherein said opposed plies of fabric are joined together in select locations to vary the location of the pocketed springs.

23. The string of springs of claim 22 wherein each of said springs is identical.

24. The string of springs of claim 22 wherein each of said springs is a coil spring.

25. A method of manufacturing a pocketed spring assembly for use in a bedding or seating product, said method comprising:

inserting a spring between opposed plies of fabric of a string of springs, joining said opposed plies of said fabric with seams to form a plurality of pockets, each of said pockets being the same height and encasing at least one spring, some of said springs being vertically offset from other springs in said string of springs due to the location of said seams, and joining said string of springs to adjacent strings of springs to form the pocketed spring assembly.

26. The method of claim 25 wherein joining opposed plies of said fabric comprises welding said plies together.

27. A method of manufacturing a pocketed spring assembly for use in a bedding or seating product, said pocketed spring assembly made of a plurality of strings of springs joined to each other, each of said string of springs comprising a piece of fabric folded such that said piece of fabric has opposed plies on opposite sides of a row of springs, said opposed plies being joined together between adjacent springs in said string of springs, said method comprising:

inserting at least one spring between said opposed plies of fabric of a string of springs, joining said opposed plies in said string of springs in select locations to create a plurality of pockets of the same height such that said fabric encases said at least one spring in each of said pockets, wherein every other pocket within said string of springs is vertically offset from adjacent pockets, and joining said string of springs to adjacent strings of springs to form the pocketed spring assembly.

28. The method of claim 27 wherein closing said pockets of said string of springs comprising welding said fabric.

29. A method of manufacturing a pocketed spring assembly for use in a bedding or seating product, said pocketed spring assembly made of a plurality of strings of springs joined to each other, each of said string of springs comprising a piece of fabric folded such that said piece of fabric has opposed plies on opposite sides of a row of springs, said opposed plies being joined together between adjacent springs in said string of springs, said method comprising:

inserting at least one spring between said opposed plies of fabric of a string of springs, joining said opposed plies in said string of springs in select locations to create a plurality of pockets such that said fabric encases said at least one spring in each of said pockets, wherein every pocket within a portion of said string of springs is of the same vertical height and every other pocket within said portion of said string of springs is vertically offset from adjacent pockets, and joining said string of springs to adjacent strings of springs to form the pocketed spring assembly.

* * * * *

UNITED STATES PATENT AND TRADEMARK OFFICE

CERTIFICATE OF CORRECTION

PATENT NO. : 6,826,796 B1
DATED : December 7, 2004
INVENTOR(S) : Niels S. Mossbeck It is certified that error appears in the above-identified patent and that said Letters Patent is hereby corrected as shown below:

Column 1,
Line 8, change “mattress” to -- mattresses --.
Line 42, change “are” to -- is --.
Line 65, delete “are”.

Column 6,
Line 37, change “low”pocket 32”” to -- “low” pocket 32” --.
Line 62, change “34” to -- 34’ --.

Column 7,
Line 3, change “initial”soft”” to -- initial “soft” --.
Line 12, delete “which”.

Column 8,
Line 24, change “glueing” to -- gluing --.

Column 10,
Line 24, change “pockets” to -- pocketed --.
Line 65, change “tow” to -- row --.

Signed and Sealed this

Fifth Day of July, 2005

JON W. DUDAS
*Director of the United States Patent and Trademark Office*